US005581815A

United States Patent [19]

Hans

[11] Patent Number: 5,581,815

[45] Date of Patent: Dec. 10, 1996

[54] GARMENT FOR DISPLAYING INFORMATION PANELS

[76] Inventor: Gerald L. Hans, 2624 Green Oak Pl., Los Angeles, Calif. 90068

[21] Appl. No.: 276,698

[22] Filed: Jul. 18, 1994

[51] Int. Cl.[6] ..... A41D 1/04

[52] U.S. Cl. ..... 2/244; 2/115; 2/228; 2/94

[58] Field of Search ..... 2/244, 108, 102, 2/115, 94, 1, 2, 1, 46, 49.1, 49.3, 49.4, 49.5, 50, 51, 69, 74, 77, 103–106, 243.1, 118–120; 40/586

[56] References Cited

U.S. PATENT DOCUMENTS

| | | | |
|---|---|---|---|
| Re. 30,899 | 4/1982 | Kallman . | |
| 1,879,341 | 2/1932 | Lapham . | |
| 2,527,258 | 10/1950 | Kahn | 2/115 |
| 2,647,261 | 8/1953 | Rassner | 2/115 |
| 2,685,690 | 8/1954 | Chrisman | 2/115 |
| 2,717,391 | 11/1955 | Bracken . | |
| 4,277,848 | 7/1981 | Boehland | 2/115 |
| 4,630,319 | 4/1986 | Mathis . | |
| 4,710,981 | 12/1987 | Sanchez | 2/115 |
| 4,875,237 | 11/1989 | Cohen . | |
| 4,987,610 | 1/1991 | Hunt | 2/115 |
| 5,086,516 | 2/1992 | Baxter et al. | 2/115 |
| 5,119,979 | 3/1992 | Kallman . | |

OTHER PUBLICATIONS

*Runner's World*, Dec. 1991, Race Ready Advertisement.

*Primary Examiner*—C. D. Crowder
*Assistant Examiner*—Gloria Hale

[57] ABSTRACT

A garment for the purpose of attaching and displaying information panels, such as a competitor's racing bib. One or more flexible flap members are permanently attached to the garment. Each distal end of the flexible flaps has a means of fastening, such as a snap fastener. Complementary means of fastening are permanently attached either to the garment, or to the proximal portion of the flexible flap. When the information panel is held in position, the complementary fasteners are coupled to secure the information panel. The garment may be worn without the information panels, as some information panels may be of a very temporary basis.

31 Claims, 2 Drawing Sheets

GARMENT FOR DISPLAYING INFORMATION PANELS

BACKGROUND

1. Field of Invention

This invention relates to clothing, specifically to clothing which can easily and quickly attach information panels, such as a competitor's racing number.

2. Discussion of Prior Art

Information can be displayed on the exterior surfaces of garments in different ways, depending upon the nature of the information itself. Some information is permanently attached, such as the silk-screened name of a baseball team on a jersey. Other information, such as a manufacturer's label may be permanently affixed for advertising purposes.

Other kinds of information, such as a competitor's racing bib displaying the competitor's number, is required to be attached only during the competition period. In practice, the most common way this is done is by temporarily attaching the racing bib to the garment with the use of two to four safety pins.

Manufacturers of racing bibs most often punch holes near the corners of the bibs. This makes for an easier attachment when using safety pins. However, there are numerous problems associated with the use of safety pins:

(a) Often, through miscalculation, safety pins are simply not available at the competition, and a competitor may not have time to find any elsewhere.

(b) It is difficult to position the racing bib on oneself, resulting in a crooked, loosely fitting, or flopping bib during the competition. This may impair the bib's visibility, cause discomfort or distraction to a competitor, or even aerodynamically hinder a competitor.

(c) Some kinds of competitions require information panels to be placed on a garment within specific guidelines, some of which may cause disqualification if not properly executed.

(d) Improper disposal of safety pins and fallen safety pins pose a serious hazard to competitors, especially at track competitions.

(e) Safety pins cause damage to many garments by causing holes and by rust stains. Rust often forms by the end of a competitive event, such as a marathon or triathlon, when safety pins are used.

Other types of attachment devices may be used to secure information panels to a garment, but they all suffer the disadvantage of not being a part of the garment, itself.

Prior to this invention, the art has included many novelty garments for attaching articles. For example, U.S. Pat. Nos. 1,879,341; 2,717,391; and 4,630,319, have pockets, straps, or other means for holding articles, such as fishing poles. None of these inventions are designed such that their attachment mechanisms will accommodate information panels.

Other prior art describe garments for the display of information. For example, U.S. Pat. No. 4,875,237 describes a jacket which can selectively display information placed into moveable panels. This prior art addresses the requirement of invisibly storing the information panels, as well. Invisible storage within the garment is not an object for the present invention.

OBJECTS AND ADVANTAGES

Accordingly, besides the objects and advantages of providing a garment which is appropriate for a given activity, other objects and advantages of my invention are:

(a) to provide a way to easily and conveniently attach temporary information panels, without the need for separate fastening devices, which may be hazardous, cause rust and holes, and may not be readily available at the time they are needed.

(b) to provide a way to repeatedly and consistently display temporary information panels in an exact, level, and perfectly positioned location on a garment, improving both visibility and neatness.

(c) to provide a way to minimize undue movement of information panels, avoiding distraction, discomfort, and aerodynamic disadvantage.

(d) to provide a garment which is specific for a given activity, in terms of where the information panels is required to be attached.

(e) Further objects and advantages are to provide a garment which can also be used even when an information panel is not required.

Still further objects and advantages will become apparent from a consideration of the ensuing description and drawings.

DRAWING FIGURES

By way of example, preferred embodiments of the present invention will be described so that the invention may be clearly understood:

FIG. 1 shows a front view of a shirt on which an information panel or racing bib is held by means of four fastener sets associated with four flexible flaps.

FIG. 2 shows a front perspective view of a flexible flap with one fastener set in an open position, and a portion of the racing bib is shown.

FIG. 3 shows a front perspective view of a flexible flap with one fastener set in an open position, permanently attached to the garment.

FIG. 4 shows a front perspective view of a flexible flap with one fastener set in an open position, permanently attached to the garment, in an alternative embodiment.

FIG. 5 shows a front view of a shod with two fastener sets holding a racing bib in place.

FIG. 6 shows a front perspective of a flexible flap with one fastener set, as utilized in the running shod application, in an open position.

REFERENCE NUMERALS IN DRAWINGS

| | | | |
|---|---|---|---|
| 10 | shirt | 11 | racing bib |
| 12a–12c | flexible flap | 13a–13c | female snap fastener |
| 14a–14c | male snap fastener | 15a–15b | stitching |
| 16a–16c | hole in racing bib | 17 | running short |
| 18 | waist band of short | | |

DESCRIPTION OF DRAWINGS

A typical embodiment of the present invention is illustrated in FIG. 1 and FIG. 2. A shirt 10 has four flexible flaps permanently attached by means of sewing. Usually each flexible flap **12*a* is composed of a fabric material such as cotton or nylon, folds easily, and provides a sturdy base for the attachment of a fastener member. Each flexible flap 12*a* is associated with a fastener set. Each fastener set, comprising a female snap fastener 13*a* and a male snap fastener 14*a*, engages an information panel or a racing bib 11** when coupled. Normally, racing bibs have holes conveniently cut by the manufacturer, and may be more easily attached than those without.

In FIG. 3 (as in FIG. 2) the male fastener member 14*a* is machined onto the shirt 10 directly. In FIG. 4, the male fastener member 14*b* is first machined onto the flexible flap 12*b*, then the flexible flap 12 is permanently attached to the shirt 10. The flexible flap 12*b* is best attached by means of permanent stitching 15*b*. The latter embodiment gives male fastener member 14*b* a strong base for applications on garments made of delicate fabric.

OPERATIONS

Figure 1:
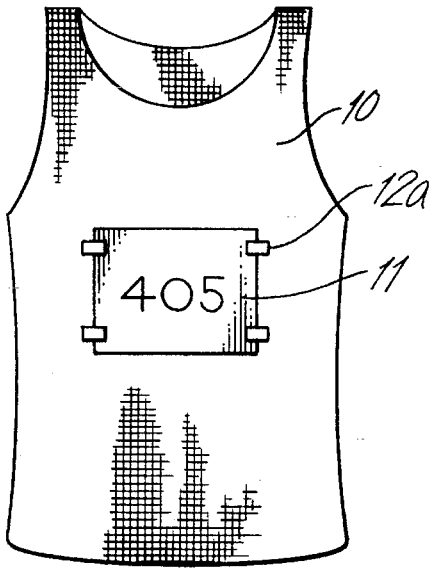

The simplicity in the manner of use of the present invention is one of the advantages over any prior art. The user first puts on the garment, for example the shirt 10 in FIG. 1. The female snap fastener members 13*a* should be decoupled from the male fastener members 14*a*. This is done by grasping the distal end of flexible flap 12*a*, and pulling away from the male fastener member 14*a*. This is repeated for each such fastener set.

Figure 2:
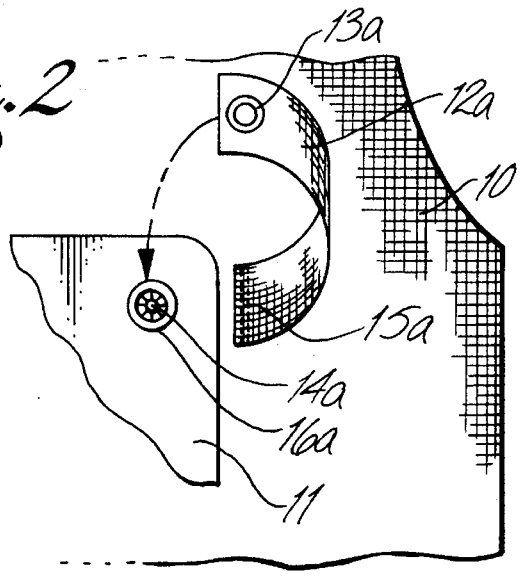
FIG. 2 shows the details of one flexible flap 12*a* and associated fastener set. The flexible flap 12*a* is permanently attached by stitching 15*a* to the shirt 10. Female fastener member 13*a* is machined permanently to the distal end of flexible fabric flap 12*a*. Male fastener member 14*a* is machined permanently to shirt 10. Wherein flexible flap 12*a* is flexible enough to fold, racing bib 11 may be aligned to receive through itself the complementary snap fastener members 13*a* and 14*a*.
Figure 3:
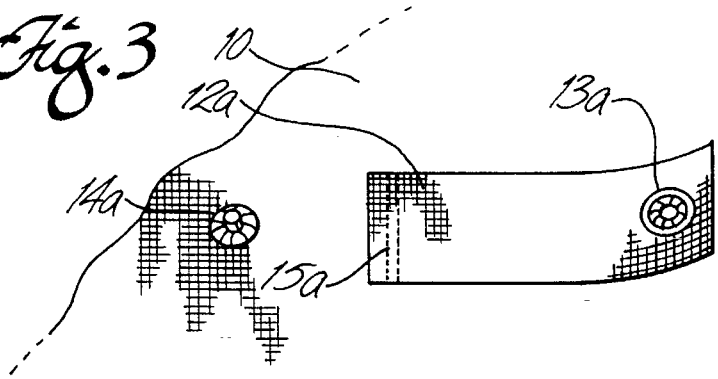
FIG. 3 and FIG. 4 show two possibilities of the positioning of the male fastener member 14*a*–14*b*.
Figure 4:
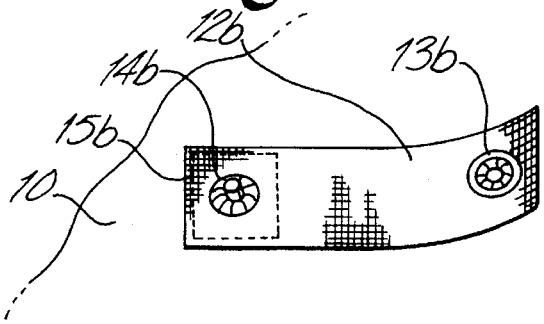

The racing bib 11 is then aligned such that hole 16*a* will receive male snap fastener 14*a* from the back side of racing bib 11, as shown in FIG. 2. The flexible flap 12*a* is folded to a point where female snap fastener 13*a* may be coupled to the complementary male snap fastener 14*a*, by gently pressing together. The racing bib is then held firmly at that point with little movement possible. These steps are repeated for the other three snap fastener sets, to fully immobilize and secure the racing bib 11.

Figure 5:
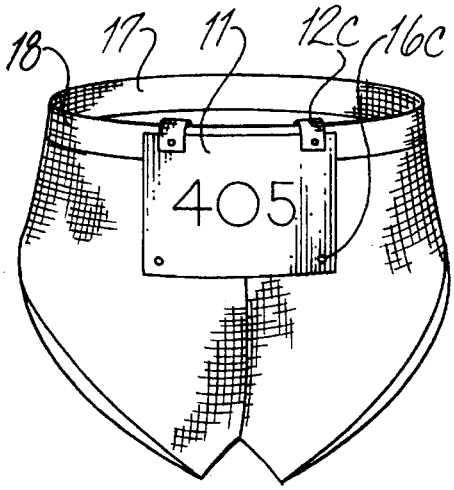
FIG. 5 shows an embodiment of the present invention as adapted to a running short 17. In this embodiment, racing bib 11 is attached only at the two top corner locations. Flexible flaps are permanently attached to the inner side of the short by sewing in this application.
Figure 6:
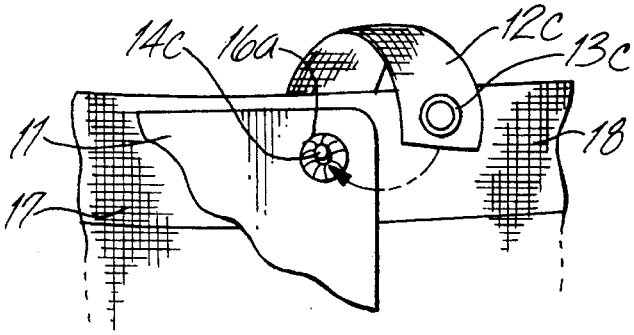
FIG. 6 shows flexible fabric flap 12*c* extending from the inside of short, to over the waist band 18. The aligned racing bib 11 receives through its hole 16*a* the complementary snap fastener members 13*c* and 14*c*. This application, although not holding the racing bib as in the shirt application, allows for freedom of leg movement.

Similarly, referring to FIG. 5 and FIG. 6, the user first puts on the running short 17. The operation is the same as that for the shirt, except the flexible flap 12*c* is folded from the top downward. There are only two points of coupling in this embodiment.

When not in use for the purpose of holding an racing bib, the garment may be worn as usual. The fastener sets are usually kept in their coupled position when not in use. In this closed position, the fastener sets are secure, and the garment functions as any normal garment.

CONCLUSION, RAMIFICATIONS AND SCOPE OF INVENTION

Thus the reader will see that the present invention is a remarkable improvement over previous means of attaching information panels to oneself. There is no need for safety pins or other extraneous fasteners which may be hazardous, cause damage to clothing, or create an inconvenience. Information panels are positioned precisely where they should be on the garment, improving visibility, comfort, and aerodynamics.

While the present invention has been described in conjunction with two principle embodiments, it is understood that modifications and variations apparent to those skilled in the art are within the scope of the present invention. These modifications and variations may be necessary to accommodate a different type garment, or a different type information panel. For example, advertising panels may be displayed on the shirts of salespeople at retail stores. Materials, including fastener type, may also vary to best accommodate an information panel type and a garment type.

Many other variations are possible. Accordingly, the scope of the invention should be determined not by the embodiments illustrated, but by the following claims and their legal equivalents.

I claim:

1. A retaining garment and a bib combination comprising:

(a) a bib having a first pair of spaced apart bib apertures extending therethrough;

(b) a garment including a first pair of spaced apart flap members attached thereto, each flap member having a distal segment which is free to extend over and onto one of the bib apertures; and (c) a first pair of fastener sets for detachably retaining the bib on the garment, each fastener set having a first fastener member which includes a projection which is sized to extend through one of the bib apertures and a second fastener member having a fastener aperture for receiving and detachably retaining a portion of the projection of the first fastener member;

wherein, (i) for each fastener set, both fastener members are attached to the garment, with one of the fastener members being attached proximate to the distal segment of one of the flap members, and (ii) the fastener members are positioned so that the distance between the projection of the first fastener members when the fastener sets are connected is substantially equal to the distance between the first pair of bib apertures.

2. The retaining garment and bib combination of claim 1 wherein the garment is a tank top.

3. The retaining garment and bib combination of claim 1 wherein the garment is shorts.

4. The retaining garment and bib combination of claim 1 wherein (i) the bib includes a second pair of spaced apart bib apertures extending therethrough; (ii) the garment includes a second pair of spaced apart flap members attached thereto, each flap member having a distal segment which is free to extend over and onto one of the second pair of bib apertures; (ill) the retaining garment further includes a second pair of fastener sets for detachably retaining the bib to the garment, each fastener set having a first fastener member which includes a projection which is sized to extend through one of the bib apertures and a second fastener member having a fastener aperture for receiving and detachably retaining a portion of the projection of the first fastener member; (iv) for each fastener set of the second pair of fastener sets, both of the fastener members are attached to the garment, with one of the fastener members being attached proximate to the distal segment of one of the flap members; and (v) the fastener members of the second pair of fastener sets are positioned so that the distance between the projection of the first fastener members when the fastener sets are connected is substantially equal to the distance between the second pair of bib apertures.

5. The retaining garment and bib combination of claim 4 wherein (i) the bib includes an upper edge, a lower edge, and opposed sides; (ii) each of the first pair of bib apertures is positioned proximate to one of the sides and the upper edge of the bib; and (iii) each of the second pair of bib apertures is positioned proximate to one of the sides and the lower edge of the bib.

6. The retaining garment and bib combination of claim 1 wherein (i) the garment includes a front surface and (ii) for each fastener set, one of the fastener members is attached directly to the front surface of the garment.

7. The retaining garment and bib combination of claim 1 wherein for each fastener set, both of the fastener members are attached directly to one of the flap members.

8. A retaining garment for releasably retaining a bib having a pair of spaced apart bib apertures extending therethrough, the retaining garment comprising:

(a) a tank top including a first pair of spaced apart flap members attached thereto, each flap member having a distal segment which is free to extend over and onto one of the bib apertures; and (b) a first pair of fastener sets for detachably retaining the bib on the tank top, each fastener set having a first fastener member which includes a projection which is sized to extend through one of the bib apertures and a second fastener member having a fastener aperture for receiving and detachably retaining a portion of the projection of the first fastener member;

wherein, (i) for each fastener set, both of the fastener members are attached to the tank top, with one of the fastener members being attached proximate to the distal segment of one of the flap members, and (ii) the fastener members are positioned so that the distance between the projection of the first fastener members when the fastener sets are connected is substantially equal to the distance between the first pair of bib apertures.

9. A retaining garment and bib combination comprising the retaining garment of claim 8 and a bib having a pair of spaced apart bib apertures extending therethrough, wherein (i) the bib includes a second pair of spaced apart bib apertures extending therethrough; (ii) the tank top includes a second pair of spaced apart flap members attached thereto, each flap member having a distal segment which is free to extend over and onto one of the second pair of bib apertures; (iii) the retaining garment further includes a second pair of fastener sets for detachably retaining the bib to the garment, each fastener set having a first fastener member which includes a projection which is sized to extend through one of the bib apertures and a second fastener member having a fastener aperture for receiving and detachably retaining a portion of the projection of the first fastener member; (iv) for each fastener set of the second pair of fastener sets, both of the fastener members are attached to the garment, with one of the fastener members being attached proximate to the distal segment of one of the flap members; and (v) the fastener members of the second pair of fastener sets are positioned so that the distance between the projection of the first fastener members when the fastener sets are connected is substantially equal to the distance between the second pair of bib apertures.

10. The retaining garment and bib combination of claim 9 wherein (i) the bib includes an upper edge, a lower edge, and opposed sides; (ii) each of the first pair of bib apertures is positioned proximate to one of the sides and the upper edge of the bib; and (iii) each of the second pair of bib apertures is positioned proximate to one of the sides and the lower edge of the bib.

11. A retaining garment and bib combination comprising the retaining garment of claim 8 and a bib having a first pair of spaced apart bib apertures extending therethrough.

12. The retaining garment of claim 8 wherein (i) the tank top includes a front surface and (ii) for each fastener set, one of the fastener members is attached directly to the front surface of the tank top.

13. The retaining garment of claim 8 wherein for each fastener set, both of the fastener members are attached directly to one of the flap members.

14. A retaining garment for releasably retaining a bib having a pair of spaced apart bib apertures extending therethrough, the retaining garment comprising:

(a) shorts including a first pair of spaced apart flap members attached thereto, each flap member having a distal segment which is free to extend over and onto one of the bib apertures; and (b) a first pair of fastener sets for detachably retaining the bib on the shorts, each fastener set having a first fastener member which includes a projection which is sized to extend through one of the bib apertures and a second fastener member having a fastener aperture for receiving and detachably retaining a portion of the projection of the first fastener member;

wherein, (i) for each fastener set, both of the fastener members are attached to the shorts, with one of the fastener members being attached proximate to the distal segment of one of the flap members, and (ii) the fastener members are positioned so that the distance between the projection of the first fastener members when the fastener sets are connected is substantially equal to the distance between the first pair of bib apertures.

15. A retaining garment and bib combinations comprising the retaining garment of claim 14 and a bib having a pair of spaced apart bib apertures extending therethrough, wherein (i) the bib includes a second pair of spaced apart bib apertures extending therethrough; (ii) the shorts include a second pair of spaced apart flap members attached thereto, each flap member having a distal segment which is free to extend over and onto one of the second pair of bib apertures; (iii) the retaining garment further includes a second pair of fastener sets for detachably retaining the bib to the garment, each fastener set having a first fastener member which includes a projection which is sized to extend through one of the bib apertures and a second fastener member having a fastener aperture for receiving and detachably retaining a portion of the projection of the first fastener member; (iv) for each fastener set of the second pair of fastener sets, both of the fastener members are attached to the garment, with one of the fastener members being attached proximate to the distal segment of one of the flap members; and (v) the fastener members of the second pair of fastener sets are positioned so that the distance between the projection of the first fastener members when the fastener sets are connected is substantially equal to the distance between the second pair of bib apertures.

16. The retaining garment and bib combination of claim 15 wherein (i) the bib includes an upper edge, a lower edge, and opposed sides; (ii) each of the first pair of bib apertures is positioned proximate to one of the sides and the upper edge of the bib; and (iii) each of the second pair of bib apertures is positioned proximate to one of the sides and the lower edge of the bib.

17. A retaining garment and bib combination comprising the retaining garment of claim 14 and a bib having a first pair of spaced apart bib apertures extending therethrough.

18. The retaining garment of claim 14, wherein (i) the shorts includes a front surface and (ii) for each fastener set, one of the fastener members is attached directly to the front surface of the shorts.

19. The retaining garment of claim 14 wherein for each fastener set, both of the fastener members are attached directly to one of the flap members.

20. A retaining garment for releasably retaining a bib having a pair of spaced apart bib apertures extending therethrough, the retaining garment comprising:

(a) a garment including a front surface and a pair of spaced apart flap members attached thereto, each flap member having a distal segment which is free to extend over and onto one of the bib apertures; and (b) a first pair of fastener sets for detachably retaining the bib on the garment, each fastener set having a first fastener member which includes a projection which is sized to extend through one of the bib apertures and a second fastener member having a fastener aperture for receiving and detachably retaining a portion of the projection of the first fastener member;

wherein, (i) for each fastener set, one of the fastener members is attached directly to the front surface of the garment and the other fastener member is attached proximate to the distal segment of one of the flap members, and (ii) the fastener members are positioned so that the distance between the projection of the first fastener members when the fastener sets are connected is substantially equal to the distance between the first pair of bib apertures.

21. The retaining garment of claim 20 wherein the garment is a tank top.

22. The retaining garment of claim 20 wherein the garment is shorts.

23. A retaining garment and bib combination comprising the retaining garment of claim 20 and a bib having a first pair of spaced apart bib apertures extending therethrough.

24. The retaining garment and bib combination of claim 23 wherein (i) the bib includes a second pair of spaced apart bib apertures extending therethrough; (ii) the garment includes a second pair of spaced apart flap members attached thereto, each flap member having a distal segment which is free to extend over and onto one of the second pair of bib apertures; (iii) the retaining garment further includes a second pair of fastener sets for detachably retaining the bib to the garment, each fastener set having a first fastener member which includes a projection which is sized to extend through one of the bib apertures and a second fastener member having a fastener aperture for receiving and detachably retaining a portion of the projection of the first fastener member; (iv) for each fastener set of the second pair of fastener sets, both of the fastener members are attached to the garment, with one of the fastener members being attached proximate to the distal segment of one of the flap members; and (v) the fastener members of the second pair of fastener sets are positioned so that the distance between the projection of the first fastener members when the fastener sets are connected is substantially equal to the distance between the second pair of bib apertures.

25. The retaining garment and bib combination of claim 24 wherein (i) the bib includes an upper edge, a lower edge, and opposed sides; (ii) each of the first pair of bib apertures is positioned proximate to one of the sides and the upper edge of the bib; and (iii) each of the second pair of bib apertures is positioned proximate to one of the sides and the lower edge of the bib.

26. A retaining garment for releasably retaining a bib having a pair of spaced apart bib apertures extending therethrough, the retaining garment comprising:

(a) a garment including a pair of spaced apart flap members attached thereto, each flap member having a distal segment which is free to extend over and onto one of the bib apertures; and (b) a first pair of fastener sets for detachably retaining the bib on the garment, each fastener set having a first fastener member which includes a projection which is sized to extend through one of the bib apertures and a second fastener member having a fastener aperture for receiving and detachably retaining a portion of the projection of the first fastener member;

wherein, (i) for each fastener set, both of the fastener members are attached directly to one of the flap members, with one of the fastener members being attached proximate to the distal segment of the flap member, and (ii) the fastener members are positioned so that the distance between the projection of the first fastener members when the fastener sets are connected is substantially equal to the distance between the first pair of bib apertures.

27. The retaining garment of claim 26 wherein the garment is a tank top.

28. The retaining garment of claim 26 wherein the garment is shorts.

29. A retaining garment and bib combination comprising the retaining garment of claim 26 and a bib having a first pair of spaced apart bib apertures extending therethrough.

30. The retaining garment and bib combination of claim 29 wherein (i) the bib includes a second pair of spaced apart bib apertures extending therethrough; (ii) the garment includes a second pair of spaced apart flap members attached thereto, each flap member having a distal segment which is free to extend over and onto one of the second pair of bib apertures; (iii) the retaining garment further includes a second pair of fastener sets for detachably retaining the bib to the garment, each fastener set having a first fastener member which includes a projection which is sized to extend through one of the bib apertures and a second fastener member having a fastener aperture for receiving and detachably retaining a portion of the projection of the first fastener member; (iv) for each fastener set of the second pair of fastener sets, both of the fastener members are attached to the garment, with one of the fastener members being attached proximate to the distal segment of one of the flap members; and (v) the fastener members of the second pair of fastener sets are positioned so that the distance between the projection of the first fastener members when the fastener sets are connected is substantially equal to the distance between the second pair of bib apertures.

31. The retaining garment of claim 30 wherein (i) the bib includes an upper edge, a lower edge, and opposed sides; (ii) each of the first pair of bib apertures is positioned proximate to one of the sides and the upper edge of the bib; and (iii) each of the second pair of bib apertures is positioned proximate to one of the sides and the lower edge of the bib.

* * * * *